United States Patent [19]

Steinberg

[11] 3,959,094

[45] May 25, 1976

[54] ELECTROLYTIC SYNTHESIS OF METHANOL FROM $CO_2$

[75] Inventor: Meyer Steinberg, Huntington Station, N.Y.

[73] Assignee: The United States of America as represented by the United States Energy Research and Development Administration, Washington, D.C.

[22] Filed: Mar. 13, 1975

[21] Appl. No.: 558,188

[52] U.S. Cl. ..... 204/77; 204/72; 204/73 R

[51] Int. Cl.[2] ..... C25B 3/04; C07C 31/06

[58] Field of Search ..... 204/72, 73 R, 77

[56] References Cited

UNITED STATES PATENTS 3,766,027 10/1973 Gregory ..... 204/72

*Primary Examiner*—F. C. Edmundson

*Attorney, Agent, or Firm*—Dean E. Carlson; Leonard Belkin

[57] ABSTRACT

A method and system for synthesizing methanol from the $CO_2$ in air using electric power. The $CO_2$ is absorbed by a solution of KOH to form $K_2CO_3$ which is electrolyzed to produce methanol, a liquid hydrocarbon fuel.

2 Claims, 1 Drawing Figure

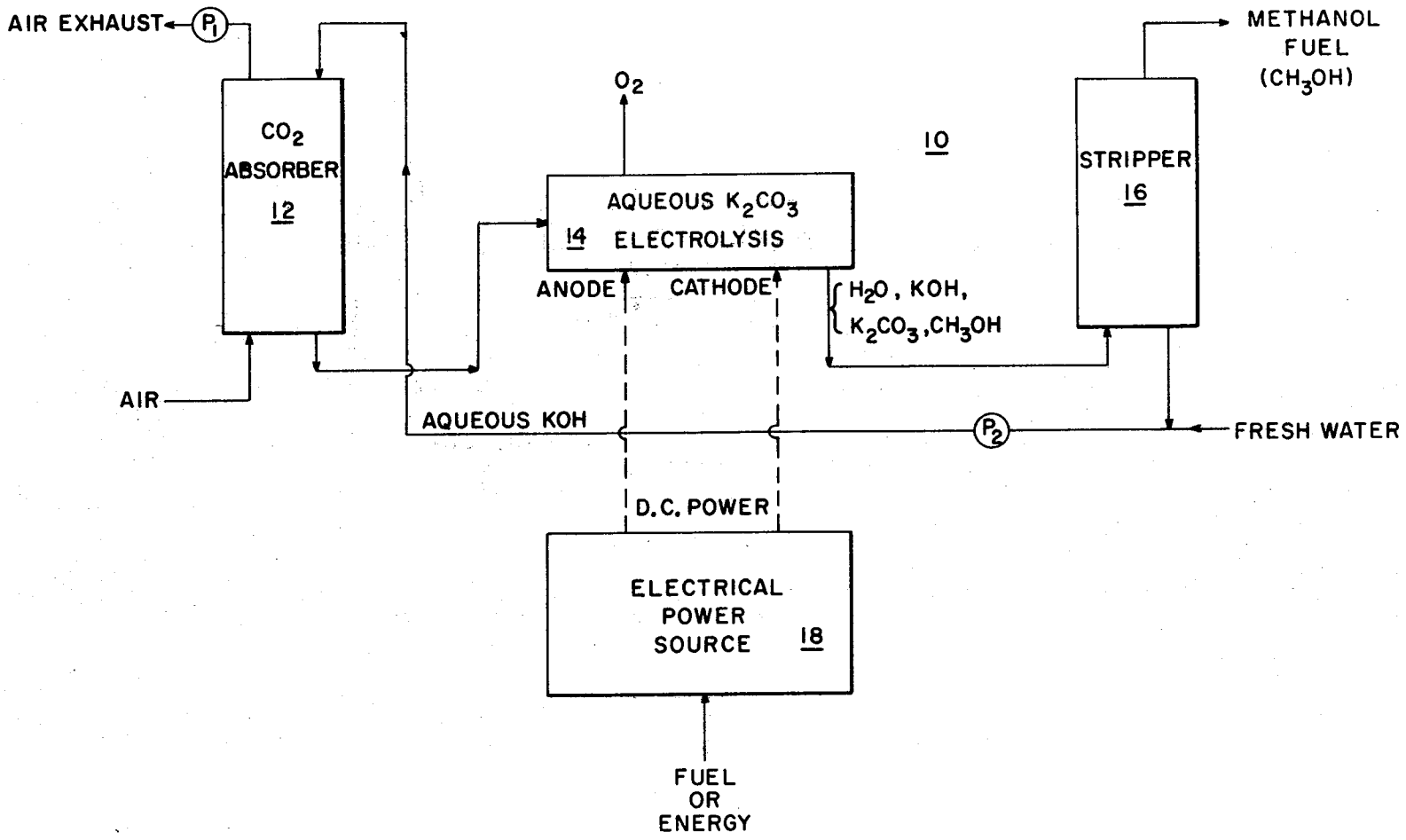
METHANOL FUEL ($CH_3OH$)
STRIPPER 16
FRESH WATER
$P_2$
10
$H_2O$, KOH, $K_2CO_3$, $CH_3OH$
AQUEOUS $K_2CO_3$ ELECTROLYSIS 14
CATHODE
ANODE
$O_2$
D.C. POWER
ELECTRICAL POWER SOURCE 18
FUEL OR ENERGY
AQUEOUS KOH
$CO_2$ ABSORBER 12
$P_1$
AIR EXHAUST
AIR

ELECTROLYTIC SYNTHESIS OF METHANOL FROM $CO_2$

BACKGROUND OF THE INVENTION

This invention was made during the course of, or under a contract with the United States Atomic Energy Commission.

The present energy economy is dependent on fossil fuels as the primary source of power. Any examination of alternate fuels must focus on the present and possible future mix of general-purpose fuels and electricity in the energy system. Presently the ratio of fossil to other fuels is approximately 10:1 for all the energy delivered to the end uses in the industrial, commercial, residential, and transportation sectors. Commensurate with this ratio approximately 20% of all of the fossil fuels consumed are converted to electricity. Recent projections indicate that in the next 30 years the present 10:1 ratio may be 4:1; thus, the predominate energy forms are and will continue to be portable and storable general-purpose fuels. In the transportation sector combustible fuels are the only major energy forms. The major fraction of these fuels is presently derived from domestic liquid or gaseous petroleum resources which are currently, or will be, in short supply by 1985. Thus imports will be required to supplement the short supply.

Current federal plans envision nuclear fission energy fulfilling a major role in the production of electricity in the near term. However, there are presently no detailed plans for using nuclear fission to supplement the short supply of fossil fuel resources. This is reasonable because coal is a more economic near-long term alternative fuel than nuclear energy and will be used to supplement domestic liquid and gaseous fossil resources.

However, it is neither practical nor even desirable to use raw coal as a direct energy source in the private transportation sector. Consequently, as might be expected, there is considerable activity devoted to the conversion of coal to alternative forms more suitable for use in automobiles and other vehicles.

As described in my U.S. Pat. application Ser. No. 491,082 filed on June 23, 1974, one alternative is that of converting coal to methanol which is compatible with existing internal combustion energy designs and the fuel distribution systems therefor.

While the direct synthesis of methanol from coal appears to be a useful approach to the problem of supplying fuel to the transportation sector, it does not permit the production of methanol from a large electric producing power plant such as the large scale nuclear breeder reactor or the fusion reactor which appear to be close to realization as major sources of electric power.

It is known that reduced products, such as formaldehyde, oxalic acid, glycollate and methanol can be produced as the result of electrolysis by the following typical reaction:

$$K_2CO_3 + 3\ H_2O \rightarrow CH_3OH + 2KOH + 3/2O_2$$

Large amounts of electrical power must be supplied in order to produce significant amounts of the methanol. At the present time there is no practical system for using the reaction described above for producing usable amounts of methanol.

SUMMARY OF THE PRESENT INVENTION

The present invention makes it possible to utilize the electrical power produced in a power plant to convert water and $CO_2$ from the air to produce methanol fuel.

In accordance with a preferred embodiment of this invention, a solution of KOH is employed to absorb $CO_2$ from air forming an aqueous solution of $K_2CO_3$, the solution is then electrolyzed to produce $CH_3OH$ and reform KOH in solution, the $CH_3OH$ is then removed, and make-up water is then added prior to repeating the aforementioned steps. Other products such as formaldehyde, oxalic acid and glycollates are also formed which can be separated and recovered as valuable products.

By the process described above, it is seen that any source of electrical power may be employed, such as coal-fired power plants. However, from an environmental point of view, nuclear power, both fission and in the future when available fusion, as well as solar energy generated power, would be preferred.

It is thus a principal object of this invention to provide for the production of methanol fuel from the utilization of electrical energy and the absorption of $CO_2$.

Other objects and advantages of this invention will hereinafter become obvious from the following description of a preferred embodiment(s) of this invention.

BRIEF DESCRIPTION OF THE DRAWING

The FIGURE shows schematically a preferred embodiment of this invention.

DESCRIPTION OF THE PREFERRED EMBODIMENT

Referring to the FIGURE, there is shown a system 10 for carrying out the process of this invention consisting of an absorber 12, an electrolytic cell 14, a stripper 16, and a source 18 of electrical (D.C.) power. One or more suitable pumps P1 and P2 would be employed to provide for circulation of the air and solutions, respectively, as will be described further below.

Absorber 12 is provided for mixing the circulating air with an aqueous solution of KOH. The $CO_2$ in the air reacts with the KOH and produces a solution containing $K_2CO_3$, KOH and water. The reaction which occurs is:

$$CO_2 + 2KOH \rightarrow K_2CO_3 + H_2O$$

Electrolytic cell 14, which in its simplest form would be a vat containing an anode and a cathode, contains the aqueous solution of KOH and $K_2CO_3$. A D.C. potential supplied by power source 18 produces electrolysis of the alkaline potassium carbonate in cell 14, the carbonate being reduced at the cathode to methanol. Potassium hydroxide and oxygen, which is released, are formed at the anode and methanol is formed at the cathode according to the following cell reactions.

Anode Reaction: $2K^+ + 8OH^- - 6e \rightarrow 2KOH + 3/2\ O_2 + 3H_2O$

Cathode Reaction: $CO_3^= + 6H_2O + 6e \rightarrow CH_3OH + 8OH^-$

Solution flowing out of cell 14 contains $CH_3OH$ and KOH as well as $K_2CO_3$. In stripper 16, by distillation, for example, the methanol is removed. With the addition of make-up water, the solution is returned to absorber 12 where the process is repeated.

Power source 18 can of course be any suitable electrical generating means, including a fossil fuel plant, nuclear fission reactor, or a fusion device.

It is thus seen that methanol fuel can be synthesized in a practical manner relying on a source of electrical power and the $CO_2$ content of air. The process itself is as environmentally safe as the power plant selected.

EXAMPLE

A 33% aqueous KOH solution containing 3.2% $CO_2$ is circulated through absorber 12 countercurrent to air until the KOH solution is 50% converted to $K_2CO_3$ and containing 6.5% $CO_2$. The potassium hydroxide-carbonate solution is electrolyzed with at least 1.4 volts D.C. current until 50% of the dissolved $CO_2$ is converted to $CH_3OH$. The concentration of methanol is 2.3% by weight. All the methanol is essentially distilled from solution and recovered.

The energy requirements for the above are as follows:

| | |
|---|---|
| Energy for $CO_2$ absorption from air and distillation of methanol | 0.8 |
| Energy for electrolytic reduction | 3.6 |
| | 4.4 Kwh per lb. of $CH_3OH$ |

This is equivalent to 29.0 Kwh(e)/gal-

-continued lon $CH_3OH$

Thus a 1000 MW(e) nuclear power reactor could produce 828,000 gallons per day of methanol which would require the conversion of 3750 tons/day of $CO_2$ from the atmosphere.

What is claimed is:

1. The method of synthesizing $CH_3OH$ comprising the steps of:

a. passing air containing $CO_2$ into contact with an aqueous solution of KOH in an absorber to cause absorption of $CO_2$ from the air by said KOH producing an aqueous solution containing $K_2CO_3$;

b. passing the solution of $K_2CO_3$ through an electrolytic cell having an anode and cathode wherein a D. C. potential is applied to cause electrolysis of the carbonate, methanol being produced at said cathode, and KOH and $O_2$ being formed at said anode, said $O_2$ being released;

c. passing the aqueous solution of $CH_3OH$ and KOH also containing $K_2CO_3$ out of said cell followed by removing the $CH_3OH$ from said solution; and d. adding make-up water to the remaining solution and returning same to said absorber.

2. The method of claim 1 in which the $CH_3OH$ is removed from solution by distillation.

* * * * *